US009122212B2

(12) United States Patent
Fujimoto et al.

(10) Patent No.: US 9,122,212 B2
(45) Date of Patent: Sep. 1, 2015

(54) FIXING DEVICE AND IMAGE FORMING APPARATUS INCLUDING SAME

(71) Applicants: Ippei Fujimoto, Kanagawa (JP); Kazuhito Kishi, Kanagawa (JP); Masahiro Samei, Osaka (JP); Hiroshi Ono, Tokyo (JP); Hiroshi Seo, Kanagawa (JP); Yasunori Ishigaya, Kanagawa (JP); Ryota Yamashina, Kanagawa (JP); Takumi Waida, Kanagawa (JP); Takeshi Yamamoto, Kanagawa (JP)

(72) Inventors: Ippei Fujimoto, Kanagawa (JP); Kazuhito Kishi, Kanagawa (JP); Masahiro Samei, Osaka (JP); Hiroshi Ono, Tokyo (JP); Hiroshi Seo, Kanagawa (JP); Yasunori Ishigaya, Kanagawa (JP); Ryota Yamashina, Kanagawa (JP); Takumi Waida, Kanagawa (JP); Takeshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/161,078

(22) Filed: Jan. 22, 2014

(65) Prior Publication Data

US 2014/0219696 A1 Aug. 7, 2014

(30) Foreign Application Priority Data

Feb. 7, 2013 (JP) ..... 2013-022337

(51) Int. Cl.
*G03G 15/20* (2006.01)

(52) U.S. Cl.
CPC .... *G03G 15/2042* (2013.01); *G03G 2215/2035* (2013.01)

(58) Field of Classification Search
CPC ..... G03G 15/2082; G03G 15/2042
USPC ..... 399/334
See application file for complete search history.

(56) References Cited

U.S. PATENT DOCUMENTS

| | | | | |
|---|---|---|---|---|
| 2002/0085851 | A1 * | 7/2002 | Murata et al. | 399/69 |
| 2012/0213540 | A1 * | 8/2012 | Igarashi | 399/69 |
| 2013/0209124 | A1 | 8/2013 | Saito et al. | |

FOREIGN PATENT DOCUMENTS

| | | | |
|---|---|---|---|
| JP | 6-095540 | | 4/1994 |
| JP | 2001-343860 | | 12/2001 |
| JP | 2005-181946 | | 7/2005 |
| JP | 2007226023 | A * | 9/2007 |
| JP | 2012252190 | A * | 12/2012 |

OTHER PUBLICATIONS

U.S. Appl. No. 14/173,171, filed Feb. 5, 2014.
U.S. Appl. No. 14/167,121, filed Jan. 29, 2014.
U.S. Appl. No. 14/174,134, filed Feb. 6, 2014.

* cited by examiner

*Primary Examiner* — Clayton E LaBalle
*Assistant Examiner* — Leon W Rhodes, Jr.
(74) *Attorney, Agent, or Firm* — Oblon, McClelland, Maier & Neustadt, L.L.P.

(57) ABSTRACT

A fixing device includes a fixing rotary body, an opposed member opposing the fixing rotary body to form a nipping portion, and a heater to heat the fixing rotary body. The heater includes heat generators arranged in a width direction of a recording medium and separately supplied with power. When an unfixed image on the medium has an image area and a non-image area, power supplied to each of the heat generators is controlled so that, of the heat generators, a first heat generator corresponding to the image area becomes a higher temperature and second heat generators corresponding to the non-image area becomes a lower temperature. When the second heat generators are adjacent to each other, power supplied to one of the second heat generators closer to the image area is set to be greater than power supplied to another of the second heat generators farther from the image area.

6 Claims, 13 Drawing Sheets

SHEET SIZE

| | $\alpha$ [°C] | $\alpha_{max}$ [°C] |
|---|---|---|
| A3 | 15 | 40 |
| A4 | 20 | 40 |
| A5 OR SMALLER | 25 | 50 |

SHEET THICKNESS

| | $\alpha$ [°C] | $\alpha_{max}$ [°C] |
|---|---|---|
| THIN | 15 | 25 |
| NORMAL | 25 | 35 |
| THICK | 30 | 40 |

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2013-022337, filed on Feb. 7, 2013, in the Japan. Patent Office, the entire disclosure of which is hereby incorporated by reference herein.

BACKGROUND

1. Technical Field

Embodiments of the present invention relate to a fixing device to fix an image on a recording medium and an image forming apparatus including the fixing device.

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. Such electrophotographic image forming apparatuses may have a fixing device to fix a toner image on a sheet of paper serving as a recording medium. Such a fixing device includes, for example, a fixing rotary body heated by a heating member and an opposed member to contact the fixing rotary body. The fixing rotary body and the opposed member contact each other to form a nipping portion. When a sheet having a toner image passes through the nipping portion, toner is fused under the heat of the fixing rotary body and fixed on the sheet.

Typically, such a heating member heats the fixing rotary body over an entire width of the sheet passing the nipping portion. As a result, the entire sheet is heated by the fixing rotary body. However, when an image is placed on only a portion of the sheet, heat energy is wasted in a non-image area, i.e., an area having no image.

To reduce such waste of heat energy in the non-image area, a fixing device is proposed to adjust a heating area in accordance with an image on a recording medium to heat a portion to be fixed without heating a portion not necessary to be fixed (for example, JP-H06-095540-A, JP-2001-343860-A, and JP-2005-181946-A).

For the above-described configuration of adjusting the heating area in accordance with the distribution of an image area and a non-image area in a desired image, in particular, when both the image area and the non-image area exist in the width direction of a sheet, a temperature difference may occur in a longitudinal direction of the fixing rotary body and the opposed member. The temperature difference in a surface of the opposed member changes the diameter size of the opposed member due to thermal expansion difference. As a result, a difference in conveyance speed of the sheet occurs in the longitudinal direction of the opposed member, thus resulting in a conveyance error (e.g., wrinkles in the sheet). In addition, the temperature difference in a surface of the fixing rotary body causes thermal stress due to a difference in thermal expansion amount. As a result, deformation called kink may occur, thus reducing image quality. Such failures may be prominent when the fixing rotary body is formed of a flexible thin member, such as belt or film.

BRIEF SUMMARY

In at least one embodiment of this disclosure, there is provided a fixing device including a fixing rotary body, an opposed member opposing the fixing rotary body to form a nipping portion between the opposed member and the fixing rotary body, and a heater to heat the fixing rotary body. The heater includes plural heat generators arranged in a width direction of a recording medium and separately supplied with power. When an unfixed image on the recording medium fed to the nipping portion has an image area and a non-image area, power supplied to each of the heat generators is controlled so that, of the heat generators, a first heat generator corresponding to the image area becomes a higher temperature and plural second heat generators corresponding to the non-image area becomes a lower temperature. When the plural second heat generators are adjacent to each other, power supplied to one of the plural second heat generators closer to the image area is set to be greater than power supplied to another of the plural second heat generators farther from the image area.

In at least one embodiment of this disclosure, there is provided an image forming apparatus including the above-described fixing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
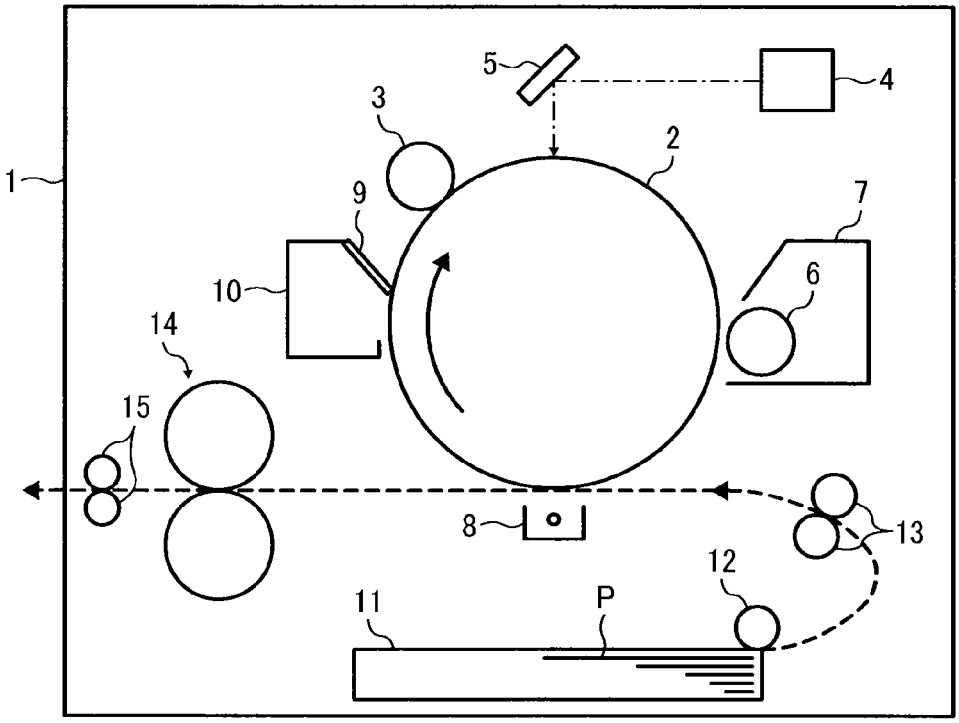
FIG. 1 is a schematic view of an image forming apparatus according to embodiments of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the invention and all of the components or elements described in the embodiments of this disclosure are not necessarily indispensable to the present invention.

Referring now to the drawings, embodiments of the present invention are described below. In the drawings for explaining the following embodiments, the same reference codes are allocated to elements (members or components) having the same function or shape and redundant descriptions thereof are omitted below.

FIG. 1 is a schematic view of an image forming apparatus according to an embodiment of the present invention.

The image forming apparatus illustrated in FIG. 1 is a monochromatic image forming apparatus, and includes a photoreceptor 2 serving as an image carrier in a middle of an apparatus body 1. The photoreceptor 2 is surrounded by a charging roller 3, a light source 4, a mirror 5, a development unit 7, a transfer unit 8, and a cleaner 10. The charging roller 3 serves as a charger, and the light source 4 and the mirror 5 constitute an exposure unit. The development unit 7 has a development roller 6, and the cleaner 10 has a cleaning blade 9.

The apparatus body 1 includes a feed tray 11, a feed roller 12, paired registration roller 13, a fixing device 14, and paired output rollers 15. The feed tray 11 stores sheets P serving as recording media, and the feed roller 12 feeds the sheets P from the feed tray 11. The paired registration rollers 13 serve as timing rollers, and the fixing device 14 fixes images on the sheets P. The output rollers 15 discharge the sheets P to the outside of the apparatus body 1. Examples of the recording media include plain paper sheets, cardboards, envelopes, thin paper sheets, coated paper sheets, tracing paper sheets, and overhead projector (OHP) sheets. In some embodiments, a bypass feed unit or manual feed unit may be provided with the apparatus body 1.

Next, a basic operation of the image forming apparatus according to the present embodiment is described with reference to FIG. 1.

When imaging operation is started, a driving device drives the photoreceptors 2 to rotate clockwise in FIG. 1, and the charging roller 3 uniformly charges an outer surface of the photoreceptors 2 at a predetermined polarity. Based on image information from, e.g., a reading device or a computer, exposure light L emitted from the light source 4 is scanned via the mirror 5 and irradiated onto the charged surface of the photoreceptor 2. As a result, an electrostatic latent image is formed on the surface of the photoreceptor 2. When the development roller 6 supplies toner to the electrostatic latent image, the electrostatic latent image is visualized (becomes visible) as a toner image.

On the other hand, when imaging operation is started, the feed roller 12 starts rotation to separate and feed the sheets P sheet by sheet from the feed tray 11. The registration rollers 13 temporarily stop the sheet P and correct a displacement from a proper position. The registration rollers 13 are rotated in synchronization with the rotation of the photoreceptor 2 to feed the sheet P so that a leading end of the toner image on the photoreceptor 2 matches a predetermined position of a leading end of the sheet P in a sheet feed direction. Thus, the toner image on the photoreceptor 2 is transferred onto the sheet P by a transfer electric field generated by the transfer unit 8. After the transfer of the toner image, the sheet P is fed to the fixing device 14, and the fixing device 14 fixes the toner image on the sheet P. The output rollers 15 discharge the sheet P to the outside of the apparatus body 1.

With rotation of the photoreceptor 2, residual toner remaining on the photoreceptor 2 without being transferred on the sheet P is carried to the cleaning blade 9 and scraped off by the cleaning blade 9. The surface of the photoreceptor 2 is diselectrified by a diselectrification device for preparation of the next imaging process.

Figure 2:
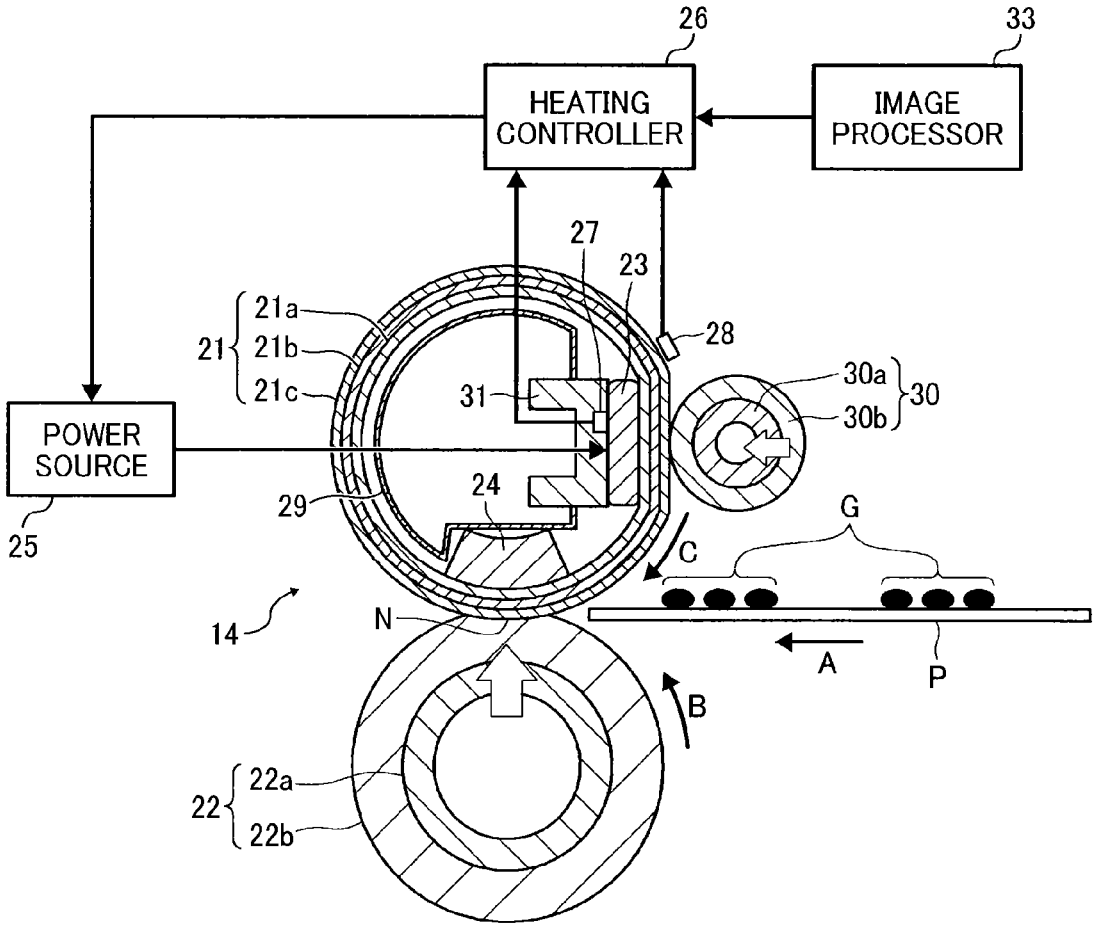
FIG. 2 is a cross-sectional view of a fixing device according to an embodiment of the present invention.

FIG. 2 is a cross sectional view of a basic configuration of a fixing device 14 according to embodiments of this invention.

As illustrated in FIG. 2, the fixing device 14 includes, e.g., a fixing belt 21, a pressure roller 22, and a heater 23. The fixing belt 21 serves as a fixing rotary body. The pressure roller 22 serves as an opposed member (or opposed rotary body) to contact the fixing belt 21 to form a nipping portion N. The heater 23 serves as a heating unit to heat the fixing belt 21.

The fixing belt 21 is formed of a thin, flexible belt (or film) member having an endless shape. For example, the fixing belt 21 includes a substrate 21*a*, an elastic layer 21*b*, and a release layer 21*c*. The substrate 21*a* includes stainless steel (SUS) and has an outer diameter of approximately 40 mm and a thickness of approximately 40 μm. The elastic layer 21*b* includes silicone rubber, has a thickness of approximately 100 μm, and coats an outer circumferential surface of the substrate 21*a*. The release layer 21*c* includes fluorine resin, such as perfluoro-alkoxyalkane (PFA) or polytetrafluoroethylene (PTFE), has a thickness of approximately 5 μm to approximately 50 μm, and coats an outer circumferential surface of the elastic layer 21*b*. The substrate 21*a* of the fixing belt 21 may include resin material, such as polyimide.

The pressure roller 22 includes a core metal 22*a* and an elastic layer 22*b*. The core metal 22*a* includes, e.g., iron and has an outer diameter of 40 mm and a thickness of 2 mm. The elastic layer 22*b* coats an outer circumferential surface of the core metal 22*a*. The elastic layer 22*b* of the pressure roller 22 includes, e.g., silicone rubber and has a thickness of 5 mm. In some embodiments, to enhance the releasability (i.e., facilitate a sheet P to release from the pressure roller 22), a release layer including fluorine resin may be formed at a thickness of 40 μm on an outer circumferential surface of the elastic layer 22*b*.

At an inner circumferential side of the fixing belt 21, a nip formation member 24 is disposed at a position opposing the pressure roller 22. The nip formation member 24 has opposed ends supported by side plates of the fixing device 14. The pressure roller 22 is pressed against the nip formation member 24 by a pressing unit, such as a pressing lever, to form the nipping portion N having a desired width at a pressure contact portion between the fixing belt 21 and the pressure roller 22.

Alternatively, in some embodiments, the fixing rotary body and the opposed member may simply contact each other without being pressed by such a pressing unit.

The pressure roller 22 is driven by a driving source, e.g., motor, to rotate in a direction indicated by arrow B in FIG. 2. When the pressure roller 22 is driven for rotation, the driving force is transmitted from the pressure roller 22 to the fixing belt 21 at the nipping portion N. As a result, with the rotation of the pressure roller 22, the fixing belt 21 is rotated in a direction (belt rotation direction) indicated by arrow C in FIG. 2. At the inner circumferential side of the fixing belt 21, a belt support member 29 is disposed to support the fixing belt 21.

The heater 23 includes sheet-shaped or plate-shaped heat generators, such as thermal heaters or ceramic heaters. At the inner circumferential side of the fixing belt 21, a stay 31 serving as a support member is disposed. The stay 31 supports the heater 23 at a position upstream from the nipping portion N in a sheet feed direction indicated by arrow A in FIG. 2 so that the heater 23 opposes an inner circumferential face of the fixing belt 21. The power source 25 is connected to the heater 23 to supply electric power to the heater 23. A heating controller 26 controls output of the power source 25. The heating controller 26 is formed of, e.g., a microcomputer including a central processing unit (CPU), a read-only memory (ROM), a random access memory (RAM), an input/output (I/O) interface, and so forth.

The fixing device 14 has a first thermistor 27 serving as a heater-temperature detector to detect the temperature of the heater 23 and a second thermistor 28 serving as a belt-temperature detector to detect the temperature of the fixing belt 21. The first thermistor 27 is disposed to directly contact the heater 23. The second thermistor 28 is disposed to oppose an outer circumferential surface of the fixing belt 21 at a position upstream from the heater 23 in the belt rotation direction indicated by arrow C in FIG. 2. Information on temperatures detected by the first thermistor 27 and the second thermistor 28 is input to the heating controller 26. The heating controller 26 is configured to control the output of the power source 25 in accordance with the input information.

A pushing roller 30 serving as a pushing member to apply pressure to the fixing belt 21 is disposed at a position opposing the heater 23 at the outer circumferential side of the fixing belt 21. The pushing roller 30 presses the fixing belt 21 from the outer circumferential side of the fixing belt 21 toward the heater 23, so that the fixing belt 21 contacts the heater 23. The pushing roller 30 has an outer diameter of approximately 15 mm to approximately 30 mm, and includes a core metal 30*a* and an elastic layer 30*b* coating an outer circumferential surface of the core metal 30*a*. The core metal 30*a* has an outer diameter of approximately 8 mm. The elastic layer 30*b* includes silicone rubber and has a thickness of approximately 3.5 mm to approximately 11 mm. In addition, to enhance the releasability, a release layer including fluorine resin may be formed at a thickness of approximately 40 μm on the elastic layer 30*b*. In this embodiment, the pushing roller 30 is pressed against the fixing belt 21 by a pressing unit. In some embodiments, for example, the pushing roller 30 may contact the fixing belt 21 without being pressed by such a pressing unit.

Next, a basic operation of the fixing device according to this embodiment is described with reference to FIG. 2.

When a power switch of the apparatus body 1 is turned on, the power source 25 supplies electric power to the heater 23 and the pressure roller 22 starts rotating in the direction indicated by arrow B in FIG. 2. By the friction force generated between the fixing belt 21 and the pressure roller 22, the fixing belt 21 is driven to rotate in the belt rotation direction indicated by arrow C in FIG. 2.

When a sheet P bearing an unfixed toner image G after the imaging process is fed to the nipping portion N between the fixing belt 21 and the pressure roller 22, the sheet P is heated and pressed. As a result, the toner image G is fixed on the sheet P. Then, the sheet P is fed from the nipping portion N and discharged to the outside of the apparatus body 1.

Below, the configuration of the fixing device 14 according to this embodiment is further described.

Figure 3:
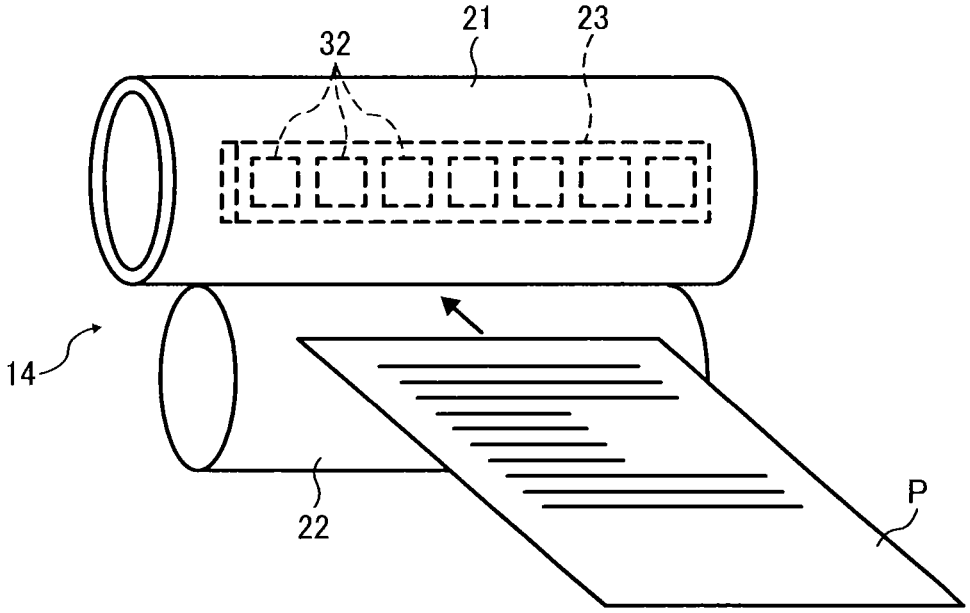
FIG. 3 is a partial perspective view of a fixing device according to an embodiment of the present invention.

As illustrated in FIG. 3, the heater 23 serving as heating member includes multiple heat generators 32 (e.g., seven in FIG. 3) arranged at even spaces in the width direction perpendicular to the feed direction of the sheet P. The heat generators 32 are connected to the power source 25 in such a manner that the power source 25 can separately supply power to the respective heat generates 32. Thus, power supplied to the heat generators 32 is controlled independent of each other by the heating controller 26.

For example, the heating controller 26 selects one or more heat generators 32 to be activated from the heat generators 32 to adjust a heating range in the width direction of the sheet, controls timings of turning the heat generators 32 ON and OFF to adjust a heating range in a rotation direction, and controls the amount of heat generation of the heat generators 32 to adjust the amount of heat generation per unit time (heating temperature). The heating controller 26 controls the amount of heat generation (output) of the heat generators 32 by changing the power supplied to the respective heat generators 32. Supplied power is changed by adjusting the voltage in analog manner or turning-on duty (the rate of turning-on time in certain time).

Image signals transmitted from an image reading device of the image forming apparatus or an external device are input to an image processor 33, and the image processor 33 performs image processing on the input signals. Image information from the image processor 33 is input into the heating controller 26, and the heating controller 26 controls the outputs of the heat generators 32 via the power source 25 in accordance with the image information.

Figure 4A:
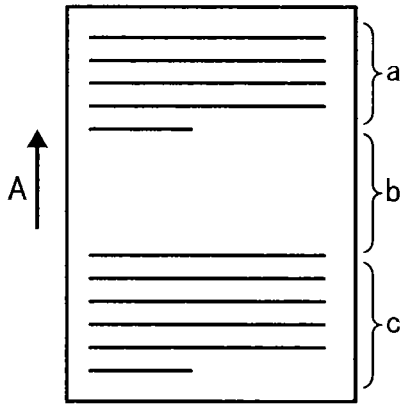
FIGS. 4A to 4C are plan views of examples of image formation patterns.

For example, as illustrated in FIG. 4A, when an image area "a", a non-image area "b", and an image area "c" are formed in this order from the leading side of the sheet P in the sheet feed direction A, preferably, fixing is performed on the image area "a" and "c", not on the non-image area "b". In such a case, based on image information obtained from the image processor 33, the heating controller 26 controls the heater 23 so that the temperature of a portion of the fixing belt 21 corresponding to the non-image area "b" is lower than the temperatures of other portions of the fixing belt 21 corresponding to the image areas "a" and "c". In other words, in such a case, at the portions corresponding to the image areas "a" and "c", power is supplied to all of the heat generators 32 in a normal way. By contrast, at the portion corresponding to the non-image area "b", the power supplied to all of the heat generators 32 is reduced or stopped. As described above, reducing or stopping the power supplied to the heat generators 32 at the portion corresponding to the non-image area "b" allows a reduction in waste consumption of heat energy at the non-image area "b".

Figure 4B:
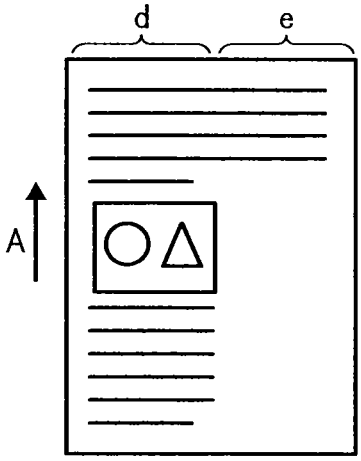

As illustrated in FIG. 4B, when both an image area "d" and an image area "e" exist in the width direction of the sheet P, the heating controller 26 controls the power source 25 to reduce or stop the power supplied to one or more of the heat generators 32 disposed at a position (on the right side in FIG.

4B) corresponding to the non-image area "e". Thus, waste consumption of heat energy at the non-image area "e" can be reduced.

Figure 4C:
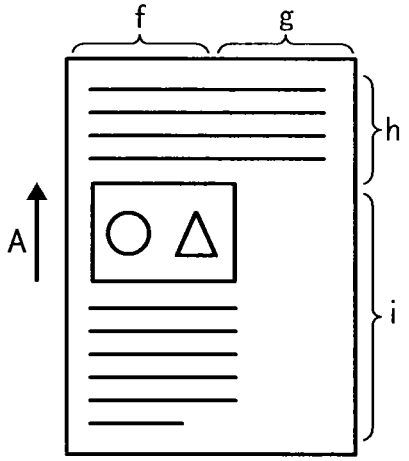

In an example illustrated in FIG. 4C, both an image area and a non-image area are mixed in both the width direction and the conveyance direction of the sheet P. In such a case, at a portion corresponding to a non-image area formed in an area in which a range "g" and a range "i" overlap each other, the power supplied to the heat generators 32 is reduced or stopped. Thus, like the above-described examples, waste consumption of heat energy at the non-image area can be reduced.

Figure 5:
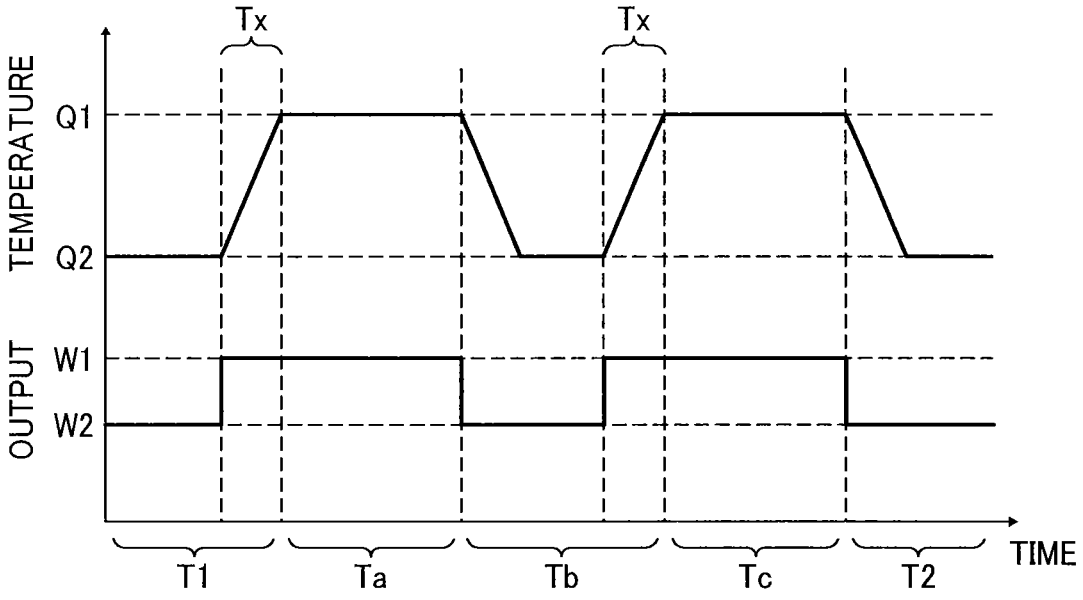
FIG. 5 is a graph of changes in the output of a heater and the temperature of a fixing belt observed when a sheet passes through a nipping portion according to an embodiment of the present invention.

FIG. 5 is a graph of changes in output of the heater and temperature of the fixing belt observed when the sheet illustrated in FIG. 4A passes the nipping portion N. Below, control of the temperature of the fixing belt according to the present embodiment is described with reference to FIG. 5.

As illustrated in FIG. 5, at timings Ta and Tc at which the image areas "a" and "c" of the sheet pass the nipping portion N, the heating controller 26 controls power supplied to the heat generators 32 so that the temperature of the fixing belt 21 reaches a first target temperature Q1 necessary for fixing images. By contrast, at a timing Tb at which the non-image area "b" passes the nipping portion N, the heating controller 26 reduces the power supplied to the heat generators 32 so that the temperature of the fixing belt 21 falls to a second target temperature Q2 lower than the first target temperature Q1, thus reducing waste consumption of heat energy.

Here, in time periods Tb, T1, and T2 in which the image areas "a" and "c" do not pass the nipping portion N, the power supplied to the heat generators 32 may be completely stopped. However, if the temperature of the fixing belt 21 extremely falls, it might be difficult to raise the temperature of the corresponding heat generator 32 to the first target temperature Q1 on arrival of an image area of the same or subsequent sheet to the nipping portion N. Hence, like the example shown in FIG. 5, an output W2 lower than an output W1 corresponding to the first target temperature Q1 is set as the output of the heat generators 32. In the time periods Tb, T1, and T2 in which the image areas "a" and "c" do not pass the nipping portion N, preferably, the temperature of the fixing belt 21 is maintained at the second target temperature Q2, which is lower than the first target temperature Q1 but higher than a room temperature, by heating the fixing belt 21 at the lower output W2. The second target temperature Q2 is determined in consideration of the performance of the heater 23, the heat capacity of the fixing belt 21, and so forth.

Generally, it takes a certain heat-up time the temperature of the fixing belt to reach a target temperature after the start of heating the fixing belt. Therefore, even if, on arrival of a leading end of the image area "a" at the nipping portion N, the heat generators 32 start to raise the temperature of the fixing belt 21 at the output W1 corresponding to the first target temperature Q1, the temperature of the fixing belt 21 might not be raised to the first target temperature Q1 in time. Hence, like the example showing in FIG. 5, taking into account the heat-up time of the fixing belt 21, the fixing belt 21 is preferably preheated at the output W1 for a time period Tx before the leading end of each of the image areas "a" and "c" arrives at the nipping portion N. However, from a viewpoint of energy saving, the preheat time Tx is preferably shorter. The heat-up time of the fixing belt 21 varies depending on the heat transmission rate of the fixing belt or the heating length in the rotation direction, and therefore is preferably determined in advance through experiments.

In the example illustrated in FIG. 5, the fixing temperature of each of the image areas "a" and "c" is set to the first target temperature Q1. In some embodiments, the fixing temperature may be different between image areas.

For example, when image areas have different image types, such as character, photograph, and diagram, different target temperatures may be set to the respective image areas in accordance with the image types. In particular, when an image area is a photographic image area, it is preferable to increase the glossiness of the image. Hence, by setting a higher target temperature for the photographic image area, desired glossiness can be obtained.

When image areas have different types of image patterns, such as solid image, halftone image, line image, and character image, or image patterns of image areas are formed by different processing methods, such as dithering methods and error diffusion methods, different target temperatures may be set to the respective image areas in accordance with the image patterns or processing methods. In this regard, the degree of isolation or density of toner particles is different between image patterns, and isolated toner particles are more likely to drop off than concentrated toner particles. Hence, a higher target temperature is set to an image pattern of isolated toner particles to suppress drop-off of the toner particles. By contrast, a lower target temperature is set to an image pattern of concentrated toner particles to reduce consumption energy.

When the adherence amount of toner is different between image areas, the temperature necessary for fixing toner is different between the image areas. Hence, the adherence amount of toner may be determined based on image information to set different target temperatures to the respective image areas in accordance with the determined adherence amount of toner. Typically, since an image having a greater adherence amount of toner needs a greater heat amount to fuse toner of the image, the target temperature is increased. By contrast, the target temperature for an image having a smaller adherence amount of toner is reduced, thus allowing a reduction in consumption energy.

For a color image forming apparatus using a plurality of different color toners, the heat amount necessary for fixing may be different between the colors of toner. In such a case, the target temperature may be set to be different between the colors of toner. For example, black toner is likely to need a smaller heat amount for fixing than any other color, such as yellow, cyan, or magenta. Hence, the target temperature may be reduced for an image area including only black toner, thus reducing consumption energy.

Below, an embodiment is described with reference to FIG. 8.

Figure 8:
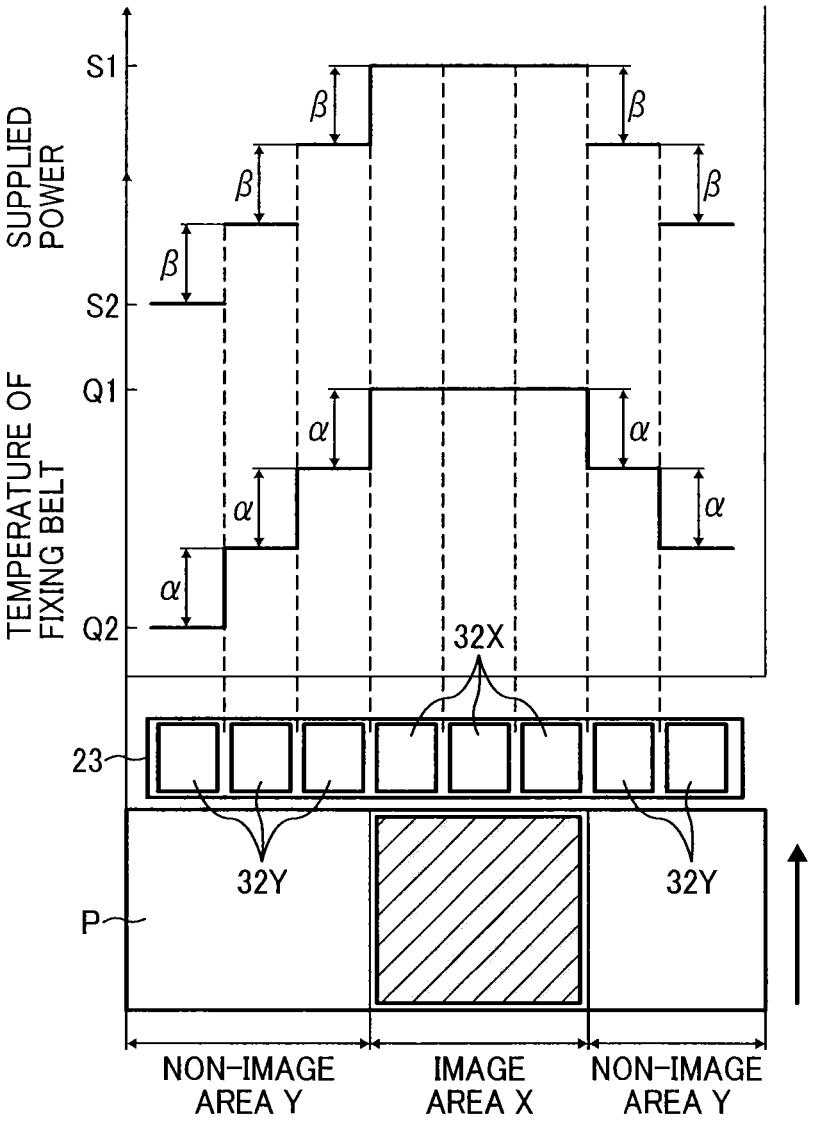
FIG. 8 is a diagram of a relation between the temperature of a fixing belt and the supplied power to heat generators when a sheet passes through a nipping portion according to an embodiment of the present invention.

In FIG. 8, an image area X and non-image areas Y exist in the width direction of a sheet P arriving at the nipping portion N (FIGS. 4B and 4C) and multiple heat generators 32 are disposed corresponding to the non-image areas Y. In FIG. 8, the image area X is formed in a middle portion in the width direction of the sheet P, and the non-image areas Y are formed on both sides of the image area X. The heater 23 illustrated in FIG. 8 includes eight heat generators 32. Of the eight heat generators 32, three heat generators 32Y on the left side in FIG. 8 correspond to the left-side one of the non-image areas Y and two heat generators 32Y on the right side in FIG. 8 correspond to the right-side one of the non-image areas Y. A portion of the fixing belt 21 corresponding to the image area X is heated to the first target temperature Q1 (e.g., 160° C.) by three central heat generators 32X. A portion of the fixing belt 21 corresponding to the right-side non-image area Y is heated by the two right-side heat generators 32Y, and a portion of the fixing belt 21 corresponding to the left-side non-image area Y is heated by the three left-side heat generators 32Y.

In this embodiment, different values of electric power are supplied to the heat generators 32Y corresponding to the non-image areas Y. An electric power supplied to one of the heat generators 32Y (e.g., the third heat generator 32Y from the left in FIG. 8) closest to the image area X is set to be greater than an electric power supplied to another of the heat generators 32 (e.g., the leftmost heat generator 32Y or the second heat generator 32Y from the left) farther away from the image area X.

Each portion of the fixing belt 21 reaches a temperature in accordance with the electric power supplied to the corresponding heat generator 32. The temperature difference between the different portions of the fixing belt 21 is basically proportional to the difference between the electric powers supplied to the respective heat generators 32. Accordingly, by the above-described control of the electric powers supplied to the heat generators 32, a stepwise temperature change occurs in the surface of the fixing belt 21 corresponding to each non-image area Y.

In this embodiment, the electric power values supplied to the heat generators 32Y corresponding to the non-image areas Y become stepwisely smaller as the heat generators 32Y are farther away from the image area X. Accordingly, the temperature of the fixing belt 21 in each of the non-image areas Y stepwisely decreases from the first target temperature Q1 with increasing distance from the image area X. In such a case, to simplify the control flow, the temperature difference $\alpha$ between adjacent steps is preferably set to constant. When the difference $\beta$ in supplied power between two adjacent heat generators 32 is set to maintain the temperature difference $\alpha$ constant, the difference $\beta$ is set to be a constant value.

For the example of FIG. 8, in an area of the fixing belt 21 corresponding to the left-side non-image area Y, the temperature of the fixing belt 21 becomes lower by three steps from the first target temperature Q1, and the left end of the fixing belt 21 is at the second target temperature Q2. In an area of the fixing belt 21 corresponding to the right-side non-image area Y, the temperature of the fixing belt 21 becomes lower by two steps from the first target temperature Q1, and the right end of the fixing belt 21 is at a temperature higher than the second target temperature Q2.

Figure 6:
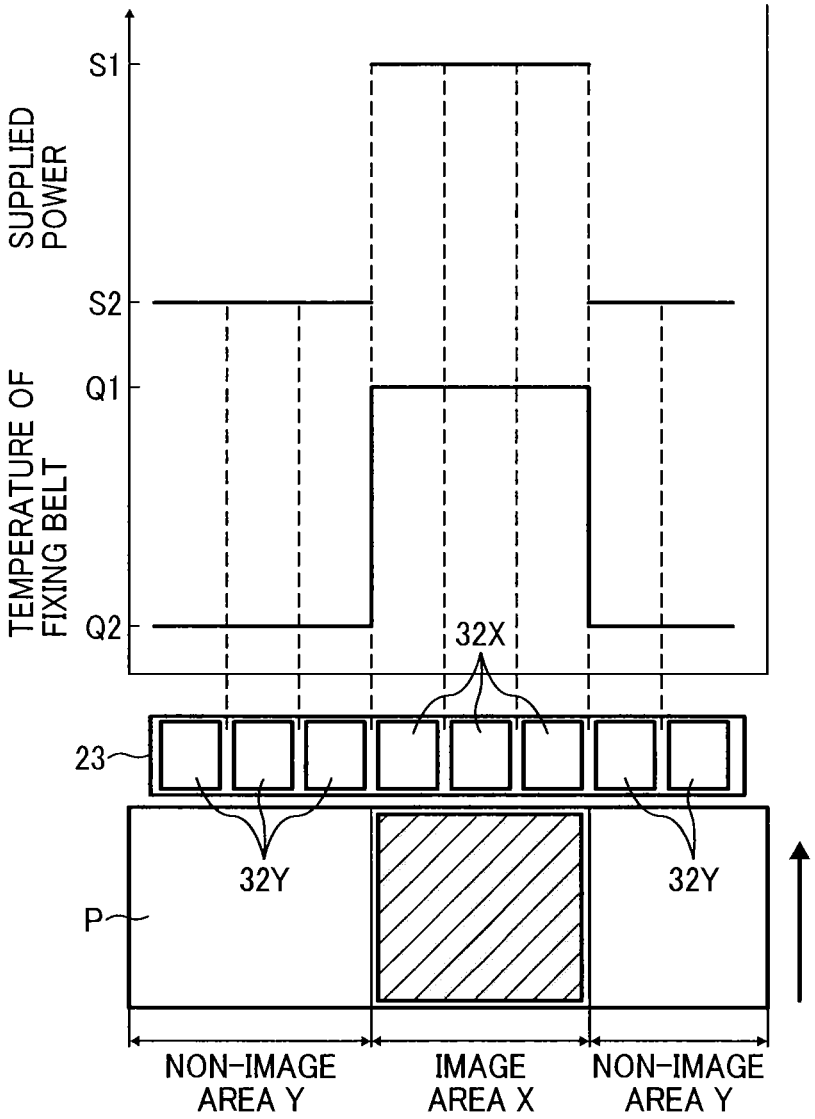
FIG. 6 is a diagram of a relation between the temperature of a fixing belt and the supplied power to heat generators when a sheet passes through a nipping portion according to a comparative example of the present invention.
Figure 7:
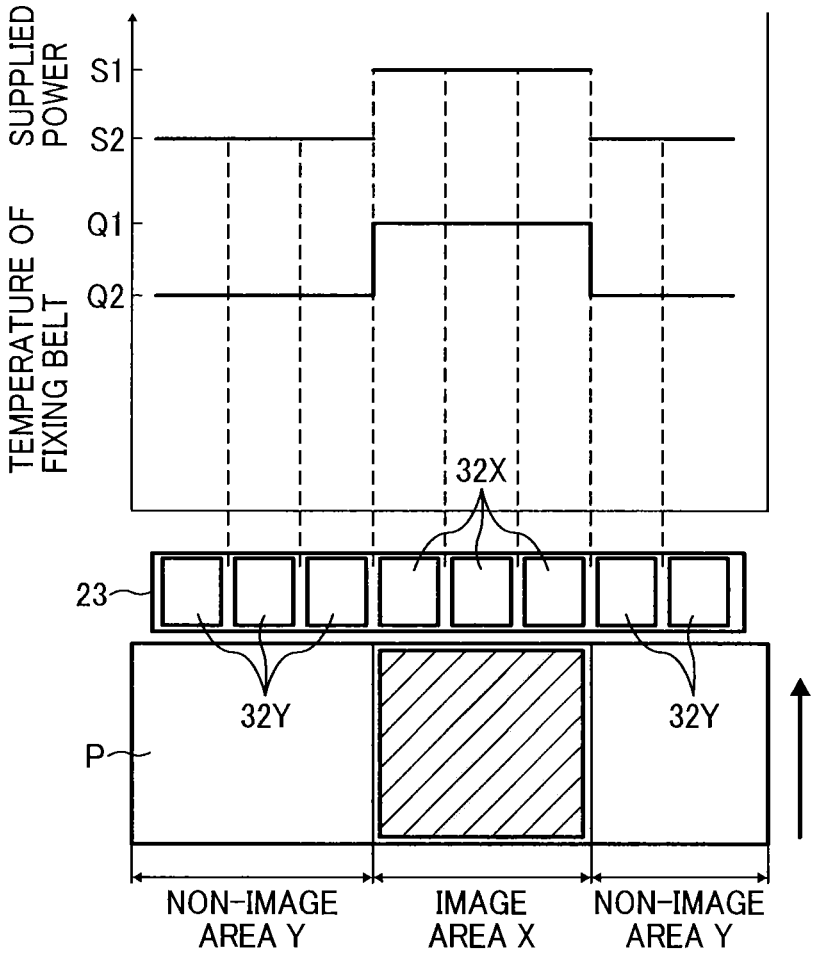
FIG. 7 is a diagram of a relation between the temperature of a fixing belt and the supplied power to heat generators when a sheet passes through a nipping portion according to a comparative example of the present invention.

Unlike the above-described configuration of FIG. 8, as illustrated in FIG. 6, if the same power value S2 is supplied to the heat generators 32Y corresponding to the non-image areas Y and all of the areas of the fixing belt 21 corresponding to the non-image areas Y become the second target temperature Q2, a relatively large temperature difference (Q1−Q2) would occur at a boundary portion between a portion of the fixing belt 21 corresponding to the image area X and a portion of the fixing belt 21 corresponding to each of the non-image areas Y. Such a large temperature difference might cause a difference in thermal expansion at the boundary portion and thermal stress, thus causing deformation of the fixing belt 21. In addition, a difference in thermal expansion might be caused in an outer surface of the pressure roller 22 to which the large temperature difference would be transmitted. As a result, the outer diameter size of the pressure roller 22 might fluctuate, thus resulting in fluctuations in the feed speed in the longitudinal direction. Alternatively, as illustrated in FIG. 7, if the power value S2 supplied to the heat generators 32Y corresponding to the non-image areas Y is set to be greater than the power value S2 in FIG. 6, the temperature of the areas of the fixing belt 21 corresponding to the non-image areas Y becomes higher than that of FIG. 6. Accordingly, the temperature difference becomes smaller at the boundary portion between the image area X and each of the non-image areas Y, and the above-described challenge can be solved. However, since the power consumption increases in the heat generators 32Y corresponding to the non-image area Y, energy loss might increase.

By contrast, the above-described configuration of FIG. 8 according to this embodiment can prevent a rapid temperature change in a partial area of the fixing belt 21. Accordingly, while suppressing energy loss in the non-image areas Y, the above-described configuration according to this embodiment can prevent deformation of the fixing belt 21 and the pressure roller 22 due to thermal expansion difference, thus preventing degradation of image quality or conveyance error (e.g., occurrence of wrinkles).

For example, when three or more heat generators 32Y corresponding to the non-image areas Y are adjacent to each other, the power values supplied to the three or more heat generators 32Y are stepwisely reduced with increasing distance from the image area X. Such a configuration can further suppress the temperature variation in the fixing belt 21 and more reliably obtain the above-described effect.

Figure 9:
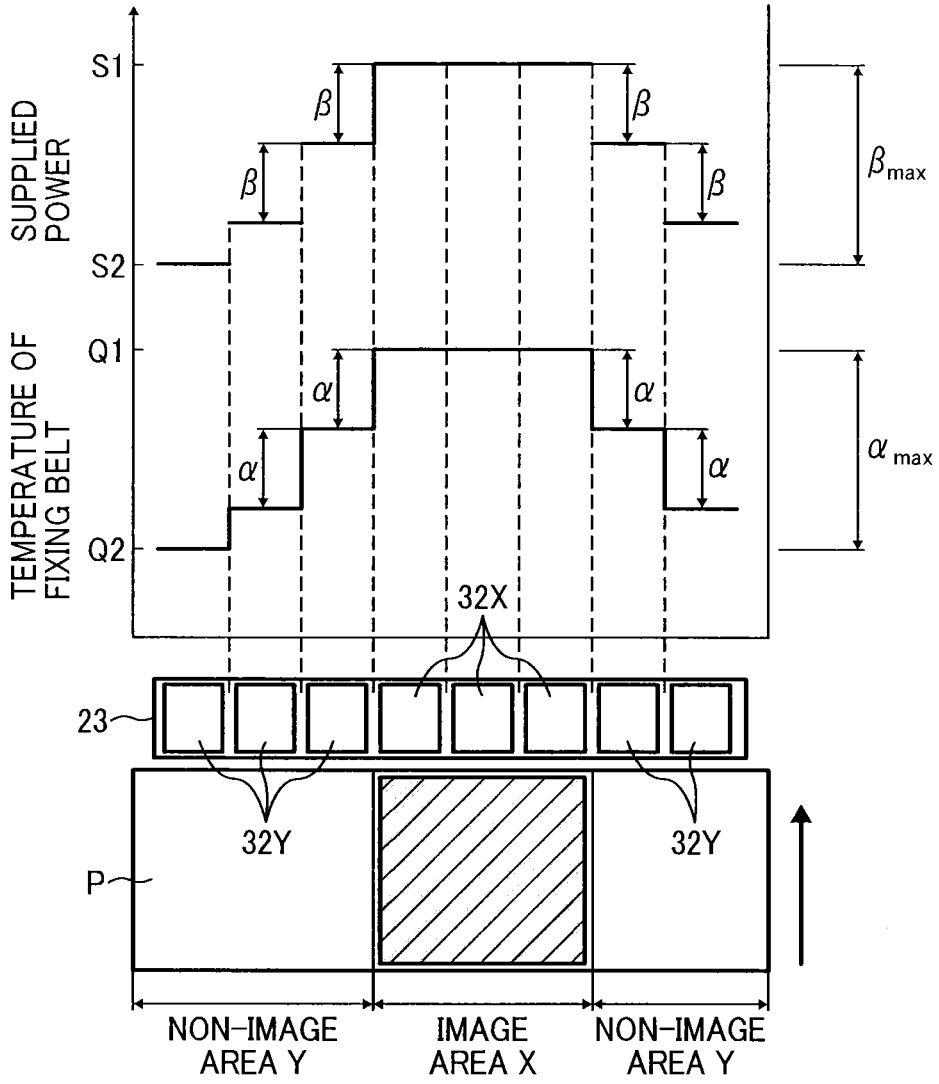
FIG. 9 is a diagram of a relation between the temperature of a fixing belt and the supplied power to heat generators when a sheet passes through a nipping portion according to an embodiment of the present invention.

Next, another embodiment of this invention is described with reference to FIG. 9. In this embodiment, a difference (maximum temperature difference $\alpha$max between a highest temperature and a lowest temperature is set to be within a certain range. The maximum temperature difference $\alpha$max is set to be as large as possible within a range in which the fixing belt 21 and the pressure roller 22 are not deformed. The difference $\beta$max between a highest power value S1 and a lowest power value S2 of power values simultaneously supplied to the heat generators 32*x* and the heat generators 32Y is set as a prescribed value so that the maximum temperature difference $\alpha$max can be obtained. As described above, prescribing the difference $\beta$max between the highest power value S1 and the lowest power value S2 of power values simultaneously supplied can more reliably prevent deformation of the fixing belt 21 and the pressure roller 22 due to thermal expansion difference.

The above-described temperature difference $\alpha$ of the fixing belt 21 or maximum temperature difference $\alpha$max is set to be a different value in response to the size or thickness of a sheet conveyed to pass the nipping portion N. If the sheet size is large (e.g., A3 size), a conveyance error, such as wrinkles, is likely to occur. Accordingly, the temperature difference $\alpha$ is preferably set to be small. By contrast, if the sheet size is small (e.g., A5 size or smaller), a conveyance error, such as wrinkles, might occur. Accordingly, the temperature difference $\alpha$ can be set to be large. In addition, if the sheet size is small (e.g., A5 size or smaller), power supplied to the heater 23 concentrates on a middle portion in the longitudinal direction, thus increasing the temperature rising of the fixing belt 21. As a result, the above-described time T2 can be set to be long.

Figures 10, 11, 12:
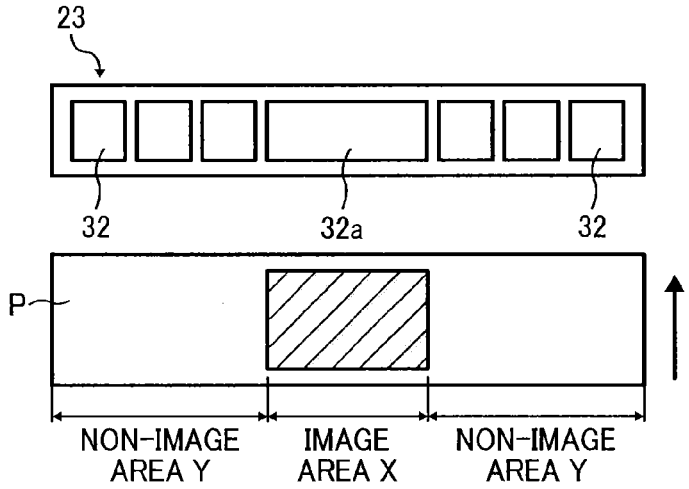
FIG. 10 is a table of a relation between sheet size and temperature difference according to an embodiment of the present invention.
FIG. 11 is a table of a relation between sheet thickness and temperature difference according to an embodiment of the present invention.
FIG. 12 is a plan view of a heater according to an embodiment of the present invention.

Thus, the temperature difference $\alpha$ and the maximum temperature difference $\alpha$max of the fixing belt 21 can be set, for example, as illustrated in FIG. 10 in accordance with the sheet size. The difference $\beta$ in supplied power between adjacent heat generators 32 and the maximum difference $\beta$max are set so that the temperature difference $\alpha$ and the maximum temperature difference $\alpha$ max illustrated in FIG. 10 are obtained.

The temperature difference $\alpha$ and the maximum temperature difference $\alpha$max can be set in accordance with the thickness of a sheet conveyed to pass the nipping portion N. For example, when the sheet is a thin sheet of paper, a conveyance error, such as wrinkles, might occur. Hence, the temperature difference $\alpha$ and the maximum temperature difference $\alpha$max are set to be small. By contrast, when the sheet is a thick sheet of paper, such a conveyance error is unlikely to occur. Hence, the temperature difference α and the maximum temperature difference αmax can be set to be large.

Thus, the adjacent temperature difference α and the maximum temperature difference αmax of the fixing belt 21 can be set, for example, as illustrated in FIG. 11 in accordance with the sheet thickness. The difference β in supplied power between adjacent heat generators 32 and the maximum difference βmax are set so that the adjacent temperature difference α and the maximum temperature difference αmax illustrated in FIG. 11 are obtained.

When the temperature difference α and the maximum temperature difference αmax set in accordance with the sheet size are different from the temperature difference α and the maximum temperature difference αmax set in accordance with the sheet thickness, a smaller temperature difference is selected. In addition, the temperature obtained by subtracting the maximum temperature difference αmax from the first target temperature Q1 is set to be not lower than the second target temperature Q2. When the temperature obtained is lower than the second target temperature Q2, the second target temperature Q2 is set as a lowest temperature of the fixing belt 21, and a supplied power value is determined to obtain the second target temperature Q2.

In the above-described embodiments, the heat generators 32 of the heater 23 have the same length. It is to be noted that, in some embodiments, one or more of the heat generators 32 have a length longer or shorter than another or others of the heat generators 32. Typically, the image area X is formed in a middle portion in the width direction of the sheet P, and the above-described temperature difference need not necessarily be set on the central heat generators 32 corresponding to the image area X. Hence, for example, as illustrated in FIG. 12, a central heat generator 32 can be longer than any other heat generator 32. In such a case, the power supplied to each of the heat generators 32 including the longer heat generator 32*a* is controlled in accordance with the amount of supplied power per unit length of the heat generators 32.

For the above-described embodiments, the fixing belt 21 is described as an example of the fixing rotary body, and the heater 23 to heat the fixing belt 21 from the inner circumferential side of the fixing belt 21 is described as an example of the heating unit. It is to be noted that the fixing rotary body or the heating unit is not limited to the above-described example.

Figure 13:
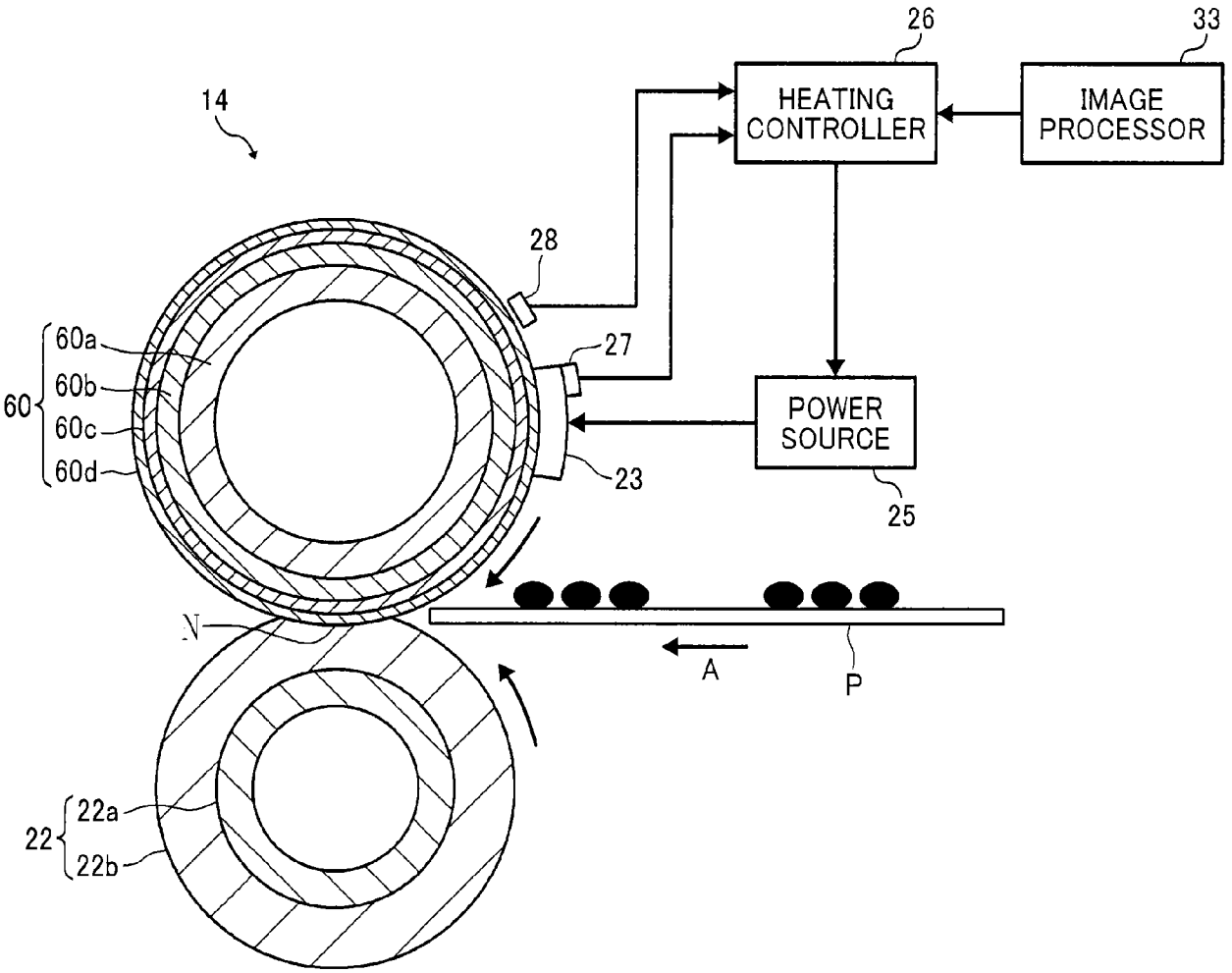
FIG. 13 is a cross-sectional view of a fixing device according to an embodiment of the present invention.

For example, in an embodiment of this invention, as illustrated in FIG. 13, a fixing roller 60 is employed as the fixing rotary body, and a heater 23 to heat the fixing roller 60 from the outer circumferential side of the fixing roller 60 is employed as the heating unit. In this embodiment, the fixing roller 60 has a core metal 60*a*, a heat insulation layer 60*b*, a heat conductive layer 60*c*, and a release layer 60*d*. The core metal 60*a* includes, e.g., aluminum and has an outer diameter of approximately 40 mm and a thickness of approximately 1 mm. The heat insulation layer 60*b* coats an outer circumferential surface of the core metal 60*a*. The heat conductive layer 60*c* coats an outer circumferential surface of the heat insulation layer 60*b*. The release layer 60*d* coats an outer circumferential surface of the heat conductive layer 60*c*.

The heat insulation layer 60*b* includes, e.g., silicone rubber and has a thickness of approximately 3 mm. In some embodiments, to enhance the insulation performance of the heat insulation layer 60*b*, the heat insulation layer 60*b* includes foamed silicone rubber which radiates less heat.

The heat conductive layer 60*c* includes, e.g., nickel. Examples of material of the heat conductive layer 60*c* include not only nickel but also iron-based alloy such as stainless, metal such as aluminum or copper, and graphite sheet. Any suitable material having a heat conductivity higher than at least the heat insulation layer 60*b* can be used as the material of the heat conductive layer 60*c*. The heat conductive layer 60*c* having such a high heat conductivity can suppress partial fluctuations in the surface temperature of the fixing roller 60 due to uneven heating of the heater 23. In addition, the heat conductive layer 60*c* can raise the temperature of an area slightly greater than an area in which the heater 23 is disposed, thus allowing covering a non-overlapping area between the heater 23 and an image. Such a configuration increases the degree of freedom in setting, e.g., the size or space of multiple heat generators 32 constituting the heater 23.

The heat conductive layer 60*c* includes, e.g., fluorine resin such as perfluoro-alkoxyalkane (PFA) or polytetrafluoroethylene (PTFE) and has a thickness of approximately 5 μm and approximately 30 μm.

A fixing device 14 illustrated in FIG. 13 includes, e.g., a power source 25, a heating controller 26, a first thermistor 27, and a second thermistor 28. The power source 25 supplies power to the heater 23. The heating controller 26 controls the heater 23 in accordance with information obtained from an image processor 33. The first thermistor 27 detects the temperature of the heater 23. The second thermistor 28 detects the temperature of the fixing roller 60. The configurations of the power source 25, the heating controller 26, the first thermistor 27, and the second thermistor 28 are basically similar to, even if not the same, the above-described embodiments, and therefore redundant descriptions thereof are omitted here.

In FIG. 13, the heater 23 contacts an outer surface of the fixing roller 60. It is to be note that the configuration of the heater 23 is not limited to the configuration illustrated in FIG. 13. For example, a non-contact-type heating unit may be used that employs an induction heating (IH) system with a coil and an inverter. For such an IH system, multiple heating coils may be arranged in an axial direction of the fixing roller 60, or multiple members for canceling magnetic flux may be arranged in the axial direction of the fixing roller 60, thus allowing control of heating areas or heating amounts.

Figure 14:
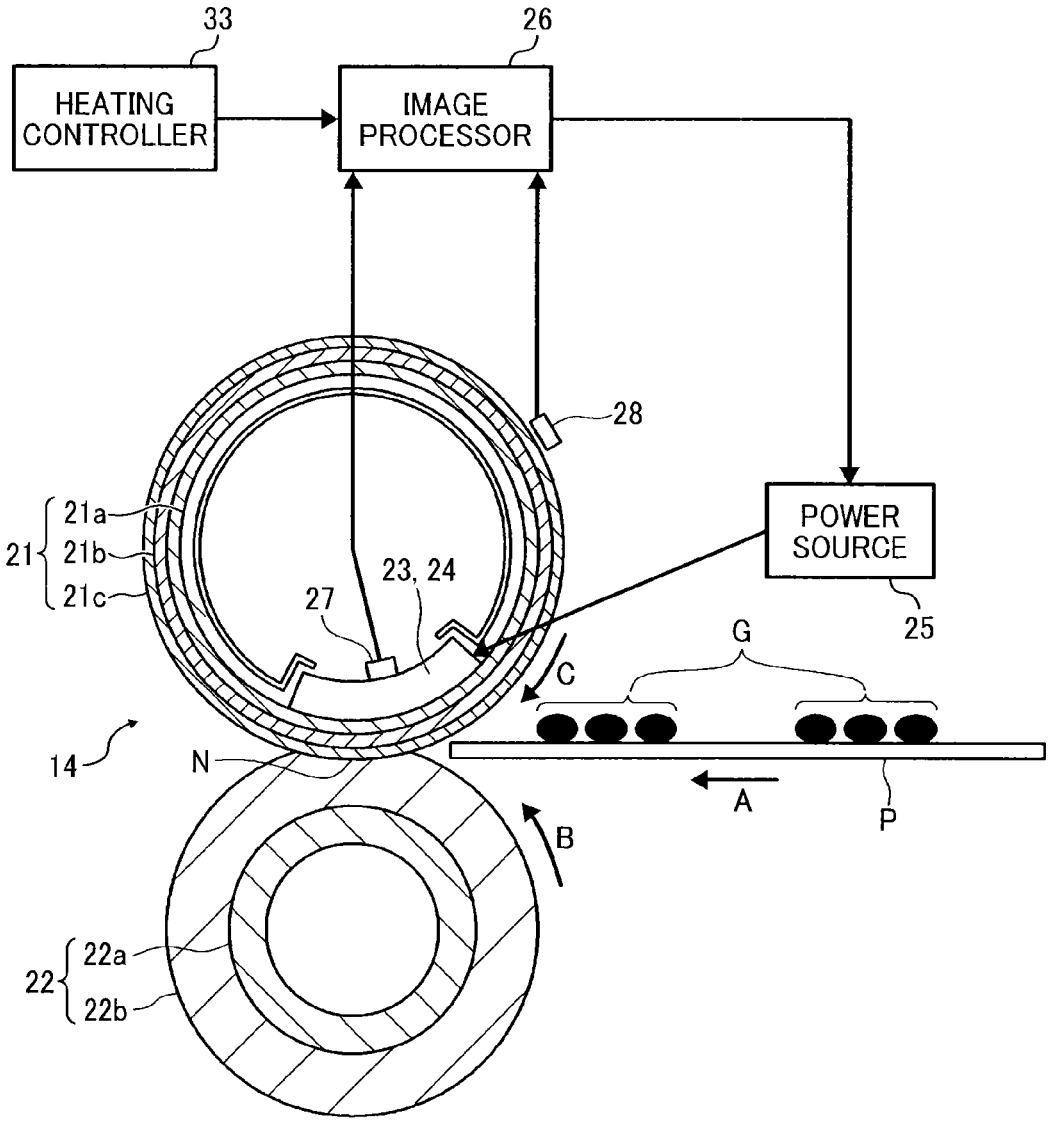
FIG. 14 is a cross-sectional view of a fixing device according to an embodiment of the present invention.

In addition, as illustrated in FIG. 14, in the fixing device illustrated in FIG. 2, the heater 23 can be disposed at a portion forming the nipping portion N within the fixing belt 21. In such a case, the heater 23 also functions as the nip formation member 24.

An image forming apparatus according to embodiments of this invention is not limited to the monochromatic image forming apparatus illustrated in FIG. 1.

Figure 15:
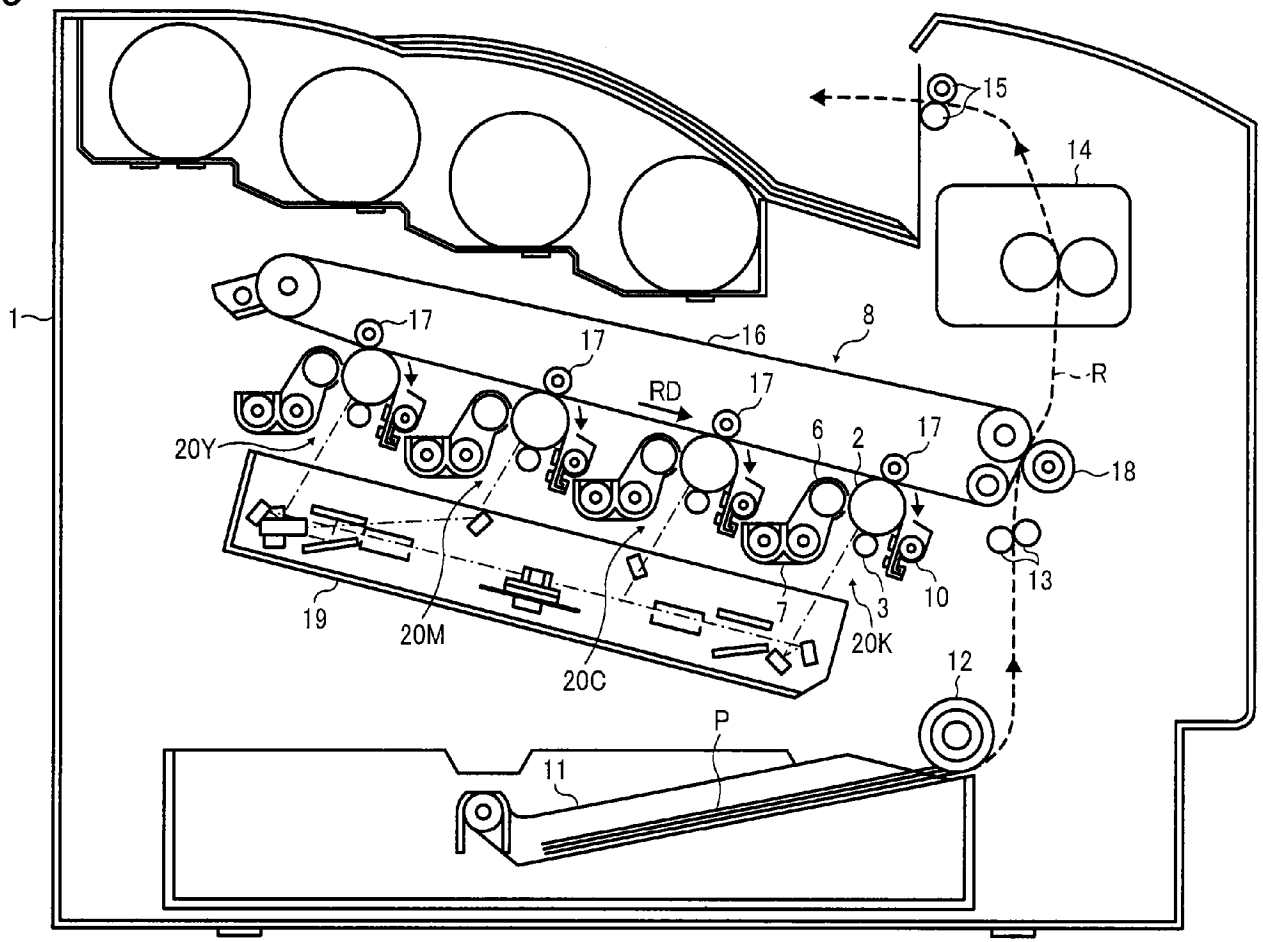
FIG. 15 is a schematic view of an image forming apparatus according to an embodiment of the present invention.

For example, a fixing device according to an embodiment of the present invention is mounted in a color image forming apparatus as illustrated in FIG. 15. The color image forming apparatus illustrated in FIG. 15 includes four process units 20Y, 20M, 20C, and 20K detachably attached relative to an apparatus body 1. The process units 20Y, 20M, 20C, and 20K have similar, even if not the same, configurations except for containing different color developers of yellow (Y), magenta (M), cyan (C), and black (K) corresponding to color separation components of color image. For example, each of the process units 20Y, 20M, 20C, and 20K includes, e.g., a photoreceptor 2, a charging roller 3, a development unit 7, and a cleaner 10. The charging roller 3 charges an outer surface of the photoreceptor 2. The development unit 7 has a development roller 6, and the cleaner 10 has a cleaning blade 9 to clean the outer surface of the photoreceptor 2.

A transfer unit 8 is disposed above the process units 20Y, 20M, 20C, and 20K and includes an intermediate transfer belt 16, plural primary transfer rollers 17, and a secondary transfer roller 18. An exposure unit 19 is disposed below the process units 20Y, 20M, 20C, and 20K.

Next, a basic imaging operation of the image forming apparatus illustrated in FIG. 15 is described below.

When imaging operation is started, the photoreceptor 2 of each of the process units 20Y, 20M, 20C, and 20K is driven for rotation and the charging roller 3 uniformly charges the outer surface of the photoreceptor 2 at a certain polarity. The exposure unit 19 irradiates laser light onto the charged surface of each photoreceptor 2 to form an electrostatic latent image on the charged surface. At this time, image information for exposing each photoreceptor 2 is single-color image information obtained by separating a desired full-color image into single-color information on yellow, cyan, magenta, and black. Each development unit 7 supplies toner onto the electrostatic latent image formed on the corresponding photoreceptor 2, and as a result, the electrostatic latent image is visualized (become visible) as a toner image.

On the other hand, when imaging operation is started, the intermediate transfer belt 16 is driven to rotate in a direction indicated by arrow RD in FIG. 15. When color toner images on the respective photoreceptors 2 arrive at the corresponding primary transfer rollers 17 with the rotation of the photoreceptors 2, the toner images on the photoreceptors 2 are sequentially superimposed one on another on the intermediate transfer belt 16 by a transfer electric field formed between the primary transfer rollers 17 and the photoreceptors 2. As a result, a full-color image is borne on an outer surface of the intermediate transfer belt 16. After the transfer of the toner image, the outer surface of each photoreceptor 2 is cleaned by the cleaner 10 and diselectrified by the diselectrification device.

At a lower portion of the apparatus body 1, a feed roller 12 starts rotation to feed sheets P sheet by sheet from a feed tray 11. After the sheet P fed to a transport path R is temporarily stopped by registration rollers 13, the registration rollers 13 feed the sheet P to a portion between the secondary transfer roller 18 and the intermediate transfer belt 16 at a proper timing. By a transfer electric field generated between the secondary transfer roller 18 and the intermediate transfer belt 16, the full-color image on the intermediate transfer belt 16 is collectively transferred onto the sheet P. Then, the sheet P is fed to the fixing device 14, and the fixing device 14 fixes the full-color toner image on the sheet P. The output rollers 15 discharge the sheet P to the outside of the apparatus body 1.

The above description relates to image forming operation for forming a full color image on a recording material. In other image forming operation, a single color image can be formed by any one of the process units 20Y, 20M, 20C, and 20K, or a composite color image of two or three colors can be formed by two or three of the process units 20Y, 20M, 20C, and 20K.

In addition, an image forming apparatus according to an embodiment of the present invention is not limited to that of any of the above-described embodiments. For example, the image forming apparatus is not limited to any other type of printer, a copier, a facsimile machine, or a multi-functional peripheral having at least one of the foregoing capabilities.

The above-described embodiments are illustrative and do not limit the present invention. Thus, numerous additional modifications and variations are possible in light of the above teachings. For example, elements at least one of features of different illustrative and embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A fixing device, comprising:

a fixing rotary body;

an opposed member opposing the fixing rotary body to form a nipping portion between the opposed member and the fixing rotary body; and a heater to heat the fixing rotary body, the heater including plural heat generators arranged in a width direction of a recording medium and separately supplied with power;

wherein, when an unfixed image on the recording medium fed to the nipping portion has an image area and a non-image area, power supplied to each of the heat generators is controlled so that, of the heat generators, a first heat generator corresponding to the image area becomes a higher temperature and plural second heat generators corresponding to the non-image area becomes a lower temperature, wherein, when the plural second heat generators are adjacent to each other, power supplied to one of the plural second heat generators closer to the image area is set to be greater than power supplied to another of the plural second heat generators farther from the image area, wherein the plural second heat generators are three or more heat generators adjacent to each other, power supplied to the three or more heat generators becomes stepwisely smaller as the three or more heat generators are farther from the image area, and wherein a difference in supplied power is constant between any adjacent two of the three or more heat generators.

2. The fixing device of claim 1, wherein the difference in supplied power is determined in accordance with a size or thickness of the recording medium.

3. The fixing device of claim 1, wherein, when power is simultaneously supplied to the heat generators at different values, a difference between a highest value and a lowest value of the different values is set to a prescribed value.

4. The fixing device of claim 3, wherein the prescribed value is determined in accordance with a size or thickness of the recording medium.

5. The fixing device of claim 1, further comprising a pushing member disposed opposing the heater to push the fixing rotary body toward the heater.

6. An image forming apparatus comprising the fixing device of claim 1.

* * * * *